United States Patent [19]

Mayring

[11] Patent Number: 4,983,882

[45] Date of Patent: Jan. 8, 1991

[54] IGNITION AMPLIFIER DEVICE

[75] Inventor: Arnold Mayring, Las Palmas de Gran Canaria, Spain

[73] Assignee: Isotec AG, Switzerland

[21] Appl. No.: 222,318

[22] Filed: Jul. 19, 1988

Related U.S. Application Data

[63] Continuation of Ser. No. 8,214, Jan. 28, 1987, abandoned.

[30] Foreign Application Priority Data

Jan. 31, 1987 [DE] Fed. Rep. of Germany ..... 3603025

[51] Int. Cl.[5] ..... H01J 7/44; H01T 13/46; F02P 15/00; H01R 13/44

[52] U.S. Cl. ..... 315/59; 315/289; 313/124; 313/134; 313/135; 328/60; 123/169 R; 439/127; 439/893

[58] Field of Search ..... 315/51, 56, 58, 59, 315/289; 313/123, 124, 118, 134, 135, 140; 328/60; 123/169 R; 439/125, 127, 128, 893, 932

[56] References Cited

U.S. PATENT DOCUMENTS

| | | | |
|---|---|---|---|
| 3,353,052 | 11/1967 | Barry | 313/140 |
| 3,963,295 | 6/1976 | Askman et al. | 439/932 |
| 4,123,688 | 10/1978 | Yoshikawa et al. | 315/58 |
| 4,549,114 | 10/1985 | Herden | 315/59 |
| 4,613,789 | 9/1986 | Herden et al. | 315/58 |

*Primary Examiner*—Eugene R. LaRoche
*Assistant Examiner*—Michael B. Shingleton
*Attorney, Agent, or Firm*—Townsend and Townsend

[57] ABSTRACT

An ignition amplifier device for the secondary circuit of an ignition system comprises the series connection of a spark gap having an electrode spacing of between 0.05 and 0.2 mm with a condenser. The so formed series connection is shunted to the electrodes of the spark plug.

14 Claims, 1 Drawing Sheet

IGNITION AMPLIFIER DEVICE

This is a continuation of application Ser. No. 07/008,124, filed Jan. 28, 1987, now abandoned.

BACKGROUND OF THE INVENTION

The invention relates to an ignition amplifier unit for the secondary circuit of an ignition system.

It is already known to provide a shielded spark plug socket with a condenser, that is shunted to the electrodes of the spark plug. By this, the ignition spark is favorably affected, and the ignition leads to a better burning process of the fuel/air mixture and to a lower consumption. However, it has been found that at higher speeds of the engine and a relatively great air gap between the electrodes of the spark plug spark formation is irregular.

BRIEF SUMMARY OF THE INVENTION

It is an object of the invention to provide an ignition amplifier unit which results in an improved and more even spark generation even at higher speeds and extreme power settings.

These and other objects are achieved by inserting a spark gap having an electrode spacing of up to 0.5 mm into one of the connecting leads of the condenser. It has been found that such a unit provides a stronger and more even spark over the complete range of speeds and that in the lower speed range of a motor fuel savings will result. Also, the oxygen percentage in the exhaust gases does not increase, which points to a better combustion.

Preferably, the electrode spacing of the spark gap is between 0.05 mm and 0.2 mm. Such a dimensioning leads to a most favourable spark formation of the spark plug in a broad speed range.

According to a special embodiment the ignition amplifier unit forms a shielded spark plug socket having a cylindrically shaped internal conductor, an insulating foil surrounding the same, and a conductive casing surrounding the insulating foil. The casing is covered with a plastic coating at least on its outwardly facing surface, which coating has a thickness of between 0.05 mm and 0.2 mm and has an aperture. The so formed subunit is surrounded by an enshrouding cylindrical casing which contacts the plastic coating and is provided with an open end adapted to fit over a spark plug and provided with a spring interlocking means.

Preferably, the shrouded casing is a metal foil and completely surrounds the inner conductor, so that no broadcast interference will be caused by the spark plug socket.

The isolating foil and the metal foil may be held in place by a thermo-shrinkable hose.

BRIEF DESCRIPTION OF THE DRAWINGS

Preferred Embodiments of the invention will now be described by way of example in the following with reference to the accompanying diagrammatic drawings, in which.

DETAILED DESCRIPTION OF PREFERRED EMBODIMENTS

Figure 1:
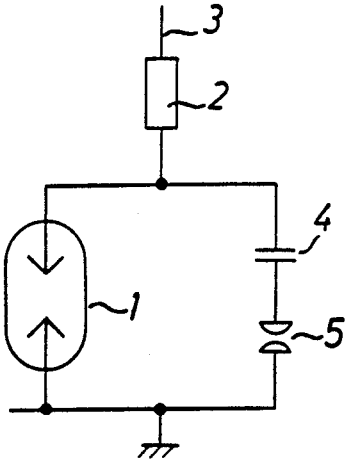
FIG. 1 is a circuit diagram of the ignition amplifier unit.

FIG. 1 shows the circuit diagram of an ignition amplifier unit, in which the spark gap 1 of a spark plug is connected via a resistor 2 to an ignition cable 3, which leads to a distributor (not shown) of an ignition system.

A condenser 4 having a capacitance of between 5 and 150 pF is connected in series with a second spark gap 5. The so formed series connection is shunted to the spark gap 1 of the spark plug. In FIG. 1, one of the electrodes of the second spark gap 5 is connected to common ground 27. However, it should be noted that the operation of the amplifier unit and the favourable effects of the same are also achieved if the condenser 4 is grounded and the second spark gap 5 is instead connected to the resistor 2.

Figure 2:
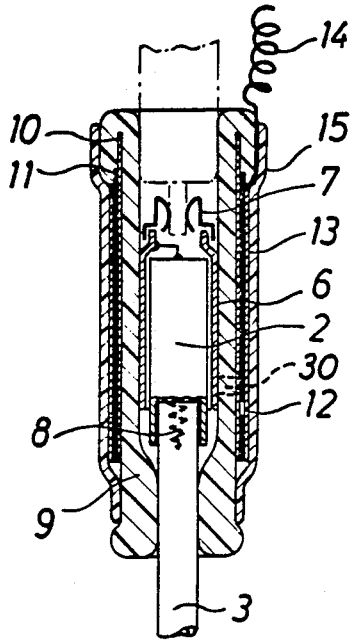
FIG. 2 is a longitudinal section through a spark plug socket.

FIG. 2 illustrates a longitudinal section of a spark plug socket or cable shoe incorporating the inventive features. The spark plug socket comprises a cylindrically shaped inner conductor 6 forming a tube-like structure in which the resistor 2 is located. One of the ends of the resistor 2 is connected to said inner conductor 6, and an electrically conductive cap 7 is provided that fits over the one end of the inner conductor 6 and is adapted to receive the terminal of the middle electrode of spark plug 29, part of which is shown in FIG. 2 in dash-dotted lines.

The other end of the resistor 2 is provided with a threaded pin 8 that may be screwed into the end of an ignition cable 3.

The inner conductor 6 and the elements attached thereto are completely encased in an insulating bushing 9 having a restricted inner diameter at its one end to snugly receive the end of the ignition cable 3. The other end of the insulating bushing 9 has a flange region having a U-shaped cross-sectional configuration. A conductive casing or sleeve 10 is surrounding the outer surface of the insulating bushing 9 and may be made for instance of at least a single layer of a metal foil. An insulating foil 11 is wrapped around casing 10, which foil has at least one aperture 12 formed as punched-through holes. The insulating foil 11 is encased by a metal foil 13, which should be large enough to completely surround the conductive casing 10 so as to prevent the dissemination of interference radiation from the spark plug.

The metal foil 13 is electrically connected to a coil spring 14, which serves to connect the metal foil 13 with common ground 27, generally the motor block into which the spark plugs are screwed.

The outer case of the spark plug socket is formed of a sleeve 15 made of a thermo-shrinkable material, which holds the conductive casing 10, the insulating foil 11, the metal foil 13, and one end of the coil spring 14 firmly together and in place. The compressive force of the sleeve 15 reduces the distance between the conductive casing 10 on the one hand and the metal foil 13 on the other hand to the thickness of the insulating foil 11, so that the free space between these two parts at the location of the aperture 12 forms the second spark gap 5, and the conductive casing 10 as well as the metal foil 13 form the electrodes of the second spark gap 5.

Figure 3:
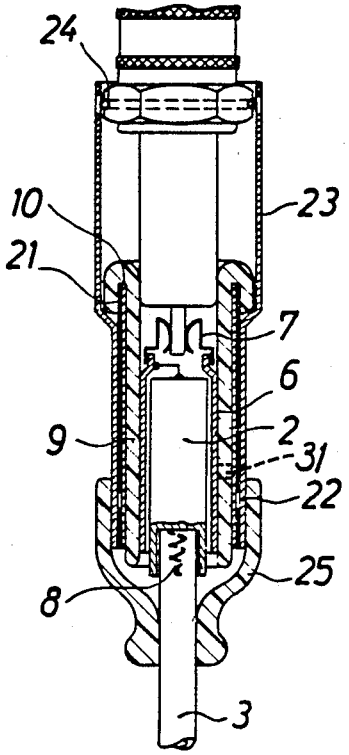
FIG. 3 is a section similar to FIG. 1 of another embodiment of a spark plug socket.

FIG. 3 shows another embodiment of a shielded spark plug socket or cable shoe in a longitudinal sectional view similar to FIG. 2. The embodiment of FIG. 3 differs from the construction as shown in FIG. 2 mainly in that a plastic coating 21 is used instead of the insulating foil 11, which coating is applied to the conductive casing 10 in any known manner except on a ring-like region 22 having a width of approximately 1 mm, which ring serves as a free space and forms the second spark gap together with the inner casing 10 and an outer metal hull 23, which is press-fitted on the plastic coating 21 and has an end region of an enlarged diameter which fits over a spark plug and is held in place on the same by means of a spring clamp 24. The other end of the metal hull 23 facing the ignition cable 3 is protected and covered by a flexible cap 25, which is made of rubber or plastic material and has a passage for the ignition cable 3.

The plastic coating 21 may alternately be formed as a thermo-shrinkable hose, the inner surface of which may be coated with an adhesive.

In FIG. 3, components which are identical to the components of the embodiment of FIG. 2 have been designated with the same reference numerals.

In the embodiments of FIGS. 2 and 3 the second spark gap 5 has one of its electrodes connected to common or ground, whereas the inner conductor 6 and the conductive casing 10, which form the electrodes of condenser 4, have a floating electrical potential. The arrangement of the condenser 4 and the second spark gap 5 may be permuted without sacrificing the favorable effects of the invention. This may be accomplished in the embodiments of FIGS. 2 and 3 by providing the aperture 12 and 22, respectively, in the insulating bushing 9 instead of in the insulating foil 11 and the shrinkable hose 21, respectively as indicated by dotted lines 30 and 31 in FIGS. 2 and 3 respectively. By this, the capacitance of the condenser may be easily increased in order to enhance a smooth operation of the motor.

The ignition amplifier unit may also be designed so as to be inserted into the ignition cable at a location distant from the spark plug. Resistor 2 may be omitted with such an embodiment.

I claim:

1. An ignition amplifier device for use with a spark plug in enhancing the spark generated at a first spark gap created by the first and second electrodes of the spark plug, comprising:

a condenser;

third and fourth electrodes, defining a second spark gap, electrically connected in series with the condenser to form an amplifier circuit; and means for connecting the amplifier circuit in parallel with the electrodes of the spark plug.

2. The device of claim 1 wherein the second spark gap does not exceed 0.5mm.

3. The device of claim 1 wherein the second spark gap does not exceed 0.05 mm and 0.2 mm.

4. The device of claim 1 wherein the condenser is formed by a first conductive cylindrical member, a second conductive cylindrical member spaced apart from and surrounding the first conductive cylindrical member and an insulative layer between the first and second conductive cylindrical members.

5. An ignition amplifier device for use with a spark plug in enhancing the spark generated at a first spark gap created by the first and second electrodes of the spark plug, comprising:

a condenser, the condenser formed by a first conductive cylindrical member, a second conductive cylindrical member spaced apart from and surrounding the first conductive cylindrical member and an insulative layer between the first and second conductive cylindrical members;

third and fourth electrodes, defining a second spark gap, electrically connected in series with the condenser to form an amplifier circuit, the third electrode being formed by one of the first and second conductive cylindrical members; and means for connecting the amplifier circuit in parallel with the electrodes of the spark plug.

6. The device of claim 5 wherein the third electrode is formed by the second conductive cylindrical member.

7. The device of claim 5 further comprising an insulating layer, having a perforation therethrough, covering the third electrode, the perforation defining said second spark gap.

8. The device of claim 5 wherein the fourth electrode is formed by a third conductive cylindrical member opposite and spaced apart from the third electrode to form an annular region therebetween.

9. An ignition amplifier device for use with a spark plug in enhancing the spark generated at a first spark gap created by the first and second electrodes of the spark plug, comprising:

a condenser formed by a first conductive cylindrical member, a second conductive cylindrical member spaced apart from and surrounding the first conductive cylindrical member and an insulative layer between the first and second conductive cylindrical members;

third and fourth electrodes, defining a second spark gap, electrically connected in series with the condenser to form an amplifier circuit, the third electrode being formed by one of the first and second conductive cylindrical members;

the fourth electrode being formed by a third conductive cylindrical member opposite and spaced apart from the third electrode to form an annular region therebetween, the annular region containing an insulating material having a perforation, the perforation defining the second spark gap; and means for connecting the amplifier circuit in parallel with the electrodes of the spark plug.

10. The device of claim 9 wherein the insulating material is an insulating foil.

11. The device of claim 10 wherein the third conductive cylindrical member is a metal foil.

12. The device of claim 11 further comprising a shrinkable sleeve surrounding the third conductive cylindrical member.

13. The device of claim 5 wherein the outermost of the conductive cylindrical members is sized to make physical contact with and fit over the spark plug.

14. The device of claim 9 wherein the perforation is an annular opening in the insulating material.

* * * * *